US007593655B2

(12) United States Patent
Nishida et al.

(10) Patent No.: US 7,593,655 B2
(45) Date of Patent: Sep. 22, 2009

(54) IMAGE FORMING APPARATUS HAVING TONER IMAGE TRANSFER SECTION

(75) Inventors: Satoshi Nishida, Saitama (JP); Mikihiko Takada, Hino (JP); Shigetaka Kurosu, Hino (JP); Hiroshi Morimoto, Akiruno (JP); Kazuteru Ishizuka, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 566 days.

(21) Appl. No.: 11/180,400

(22) Filed: Jul. 12, 2005

(65) Prior Publication Data

US 2006/0110175 A1 May 25, 2006

(30) Foreign Application Priority Data

Nov. 22, 2004 (JP) ..... 2004-337227

(51) Int. Cl.
*G03G 15/00* (2006.01)
*G03G 15/16* (2006.01)

(52) U.S. Cl. ..... 399/49; 399/66

(58) Field of Classification Search ..... 399/49, 399/60, 66, 72, 302, 308, 314
See application file for complete search history.

(56) References Cited

U.S. PATENT DOCUMENTS

| | | | | |
|---|---|---|---|---|
| 5,300,983 | A * | 4/1994 | Paxon | 347/112 |
| 6,115,561 | A * | 9/2000 | Fukushima | 399/49 |
| 7,113,712 | B2 * | 9/2006 | Gomi | 399/48 |
| 2004/0208662 | A1 * | 10/2004 | Ichikawa et al. | 399/49 |

FOREIGN PATENT DOCUMENTS

| | | | |
|---|---|---|---|
| JP | 04340567 | A * | 11/1992 |
| JP | 06194917 | A * | 7/1994 |
| JP | 10228164 | A * | 8/1998 |
| JP | 2003241478 | A * | 8/2003 |

* cited by examiner

*Primary Examiner*—Robert Beatty
(74) *Attorney, Agent, or Firm*—Squire, Sanders & Dempsey L.L.P.

(57) ABSTRACT

An image forming apparatus sets the optimum transfer bias based on density of some sets of toner patches formed on an image bearing member or an intermediate transfer member. The toner patches are categorized into at least two groups according to their length in the main scanning direction.

7 Claims, 11 Drawing Sheets

SYMBOLS : a) WHEN THE QUANTITY OF TONER CHARGE IS 30 Q/M (μc/g)

▲ : FIRST TONER PATCH △ : SECOND TONER PATCH b) WHEN THE QUANTITY OF TONER CHARGE IS 40 Q/M (μc/g)

● : FIRST TONER PATCH ○ : SECOND TONER PATCH

SYMBOLS : a) WHEN THE QUANTITY OF TONER CHARGE IS 30 Q/M (μc/g)

▲ : FIRST TONER PATCH △ : SECOND TONER PATCH b) WHEN THE QUANTITY OF TONER CHARGE IS 40 Q/M (μc/g)

● : FIRST TONER PATCH ○ : SECOND TONER PATCH

IMAGE FORMING APPARATUS HAVING TONER IMAGE TRANSFER SECTION

RELATED APPLICATION

This application is based on Japanese Patent Application No. 2004-337227 filed in Japan on Nov. 22, 2004, the entire content of which is hereby incorporated by reference.

BACKGROUND

1. Field of the Invention

This invention relates to an image forming-apparatus such as a copying machine and a printer which uses an electrophotographic process and particularly to transfer-controlling in the image forming apparatus.

2. Description of Related Art

The most basic function of the transfer unit in the image forming apparatus is to transfer toner images completely from an image bearing member to transfer paper or intermediate transfer member or to transfer primary transferred toner images from an intermediate transfer member completely to transfer paper as secondary images. Various transfer-bias controlling technologies have been proposed to effectively control the basic transfer function of the transfer unit.

For example, one of such technologies is the ATVC (Active Transfer Voltage Control) technology. The ATVC technology applies a current to the transfer unit while no image is formed, reads this current and voltage values, and determines an optimum transfer bias. (See Japanese Patent Application 2001-117376.)

Another proposed technology takes steps of forming a plurality of toner patches of the same shape on a photoreceptor, applying different intermediate transfer biases to the toner patches, intermediately transferring the toner patches to an intermediate transfer member, detecting the quantity of toner attached to each toner patch on the intermediate transfer member, and determining an optimum intermediate transfer bias. (See Japanese Patent Application 2000-321832.)

Still another proposed technology is a prospective control technology which selects a predetermined transfer bias according to the result of measurement of environmental conditions such as relative humidity in actual image formation processes and running times of the image forming apparatus.

However, in every conventional technology, it has been difficult to prevent transfer failures due to immigration of great particles in toners.

SUMMARY

An object of the present invention is to provide an image forming apparatus which can control transferring to solve the above problems.

Another object of the present invention is to provide an image forming apparatus which can obtain optimum transfer biases by a simple control process.

An object of the present invention can be achieved as following.

In accordance with one aspect of the present invention, an image forming apparatus comprises an image bearing member, an intermediate transfer member, a transfer unit which transfers toner images formed on the image bearing member to the intermediate transfer member at a primary transfer bias, and then transfers the toner images on the intermediate transfer member to a substrate at a secondary transfer bias, a control unit which forms a plurality of toner patches on the image bearing member, which are categorized into at least two groups according to their length in the main scanning direction, and transfers the toner patches to the intermediate transfer member at various primary transfer biases, and a density sensor which measures densities of the toner patches transferred to the intermediate transfer member, and wherein the control unit sets the optimum primary transfer bias based on the measuring results of the density sensor.

The invention itself, together with further objects and attendant advantages, will best be understood by reference to the following detailed description taken in conjunction with the accompanying, drawings.

BRIEF DESCRIPTION OF THE DRAWINGS

In the following description, like parts are designated by like reference numbers throughout the several drawings.

DETAILED DESCRIPTION OF THE PREFERRED EMBODIMENTS

Below will be explained developing agents used in the image forming apparatus prior to the explanation of embodiments of image forming apparatus. The developing agent to be used is a 2-component developing agent comprising a toner and a carrier. Color toners to be used are yellow, magenta, and cyan color toners. Optimum toners are polymeric toners whose mass average particle diameters are 3 to 8 μm. Polymeric toners enable formation of high-resolution images whose densities are stable without fogs. The mass average particle diameters are average particle diameters by mass and measured by "Coulter Counter TA-II" or "Coulter Multisizer" (fabricated by Beckman Coulter, Inc.) equipped with a wet type disperser. Optimum carriers should have mass average particle diameters of 30 to 65 μm and the intensity of magnetization of 20 to 70 emu/g.

Figure 1:
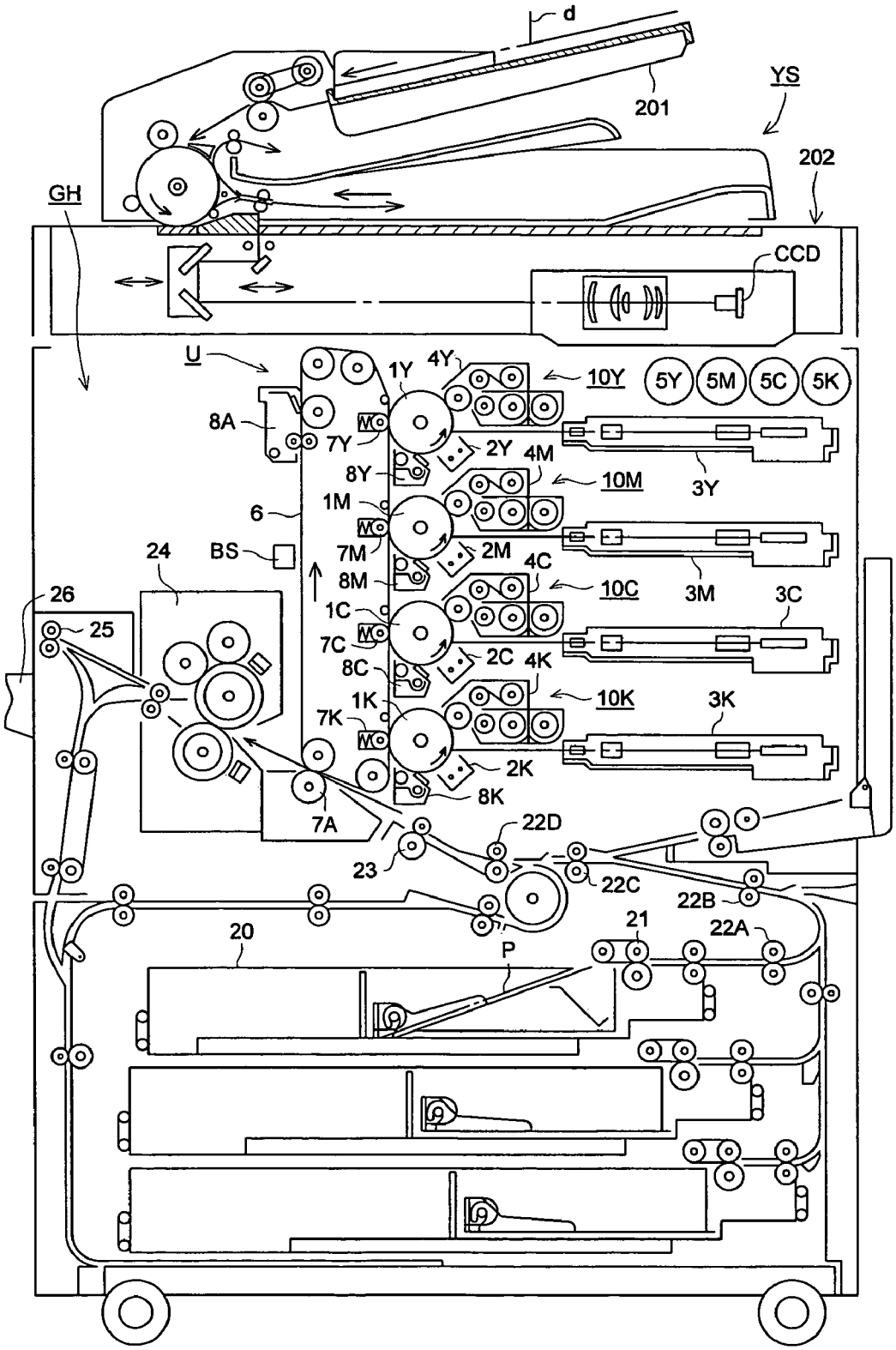
FIG. 1 is a sectional view of the simplified configuration of an image forming apparatus which is an embodiment of this invention.

Next will be explained concrete embodiments of image forming apparatus of this invention. FIG. 1 is a sectional view of the simplified configuration of an image forming apparatus which is an embodiment of this invention.

As shown in FIG. 1, the image forming apparatus is a so-called tandem type color image forming apparatus which transfers toner images from the image bearing member in sequence to the intermediate transfer member in an overprint manner and transfers the overprinted images from the intermediate transfer member to a recording medium at a time. This image forming apparatus comprises some sets of image forming units 10Y, 10M, 10C, and 10K, intermediate transfer unit U, paper delivery unit, and fixing unit 24. Document reading device YS is provided on the top of the main body of the image forming apparatus GH.

Image forming unit 10Y for forming a yellow color image comprises charging unit 2Y, exposing unit 3Y, developing unit 4Y, primary transfer unit 7Y, and cleaning unit 8Y which are disposed around the image bearing member 1Y (also called a photoreceptor drum). Image forming unit 10M for forming a magenta color image comprises image bearing member 1M, charging unit 2M, exposing unit 3M, developing unit 4M, primary transfer unit 7M, and cleaning unit 8M. Image forming unit 10C for forming a cyan color image comprises image bearing member 1C, charging unit 2C, exposing unit 3C, developing unit 4C, primary transfer unit 7C, and cleaning unit 8C. Similarly, image forming unit 10K for forming a black color image comprises image bearing member 1K, charging unit 2K, exposing unit 3K, developing unit 4K, primary transfer unit 7K, and cleaning unit 8K. Each image forming unit 10 performs charging, exposing, and developing to form an image of the associated color on the image bearing member.

The intermediate transfer unit U comprises intermediate transfer member 6 made of a semi-conductive endless belt which is supported and moved to circulate by a plurality of rollers.

Images of respective colors formed by the image forming units (10Y, 10M, 10C, and 10K) are sequentially transferred to the circulating intermediate transfer member 6 by the associated primary transfer units (7Y, 7M, 7C, and 7K) in synchronism and overprinted into a single color image. A recording medium (also called transfer paper) P is taken out from paper cassette 20 by paper feeding unit 21, carried to secondary transfer unit 7A by a plurality of intermediate rollers (22A, 22B, 22C, and 22D) and registration rollers 23. In the secondary transfer unit (7A), the overprinted color image is batch-transferred to the paper (P) from the intermediate transfer member 6. The paper P having the color image is sent to fixing unit 24, fixed there, and ejected by ejection rollers onto ejection tray 26 outside the image forming apparatus.

Meanwhile, after transferring the overprinted color image to the paper by the secondary transfer unit (7A), the intermediate transfer member (6) separates the printed paper by its curvature and is cleaned (to remove the residual toners) by cleaning unit 8A.

The image forming apparatus of FIG. 1 has the major physical properties below.

System speed: 220 mm/s

Image bearing member: made of POC

Primary transfer roller: Semi-conductive NBR sponge rubber of $1\times10^7\Omega$ in resistance, 20 mm in outer diameter (ϕ), and Morse hardness of 25

Possible primary transfer current output range: 5 to 50 μA (0 to 5 kV)

Secondary transfer roller and backup roller: 30 mm in outer diameter (ϕ), 16 mm in core diameter (ϕ), semi-conductive NBR solid rubber of $4.0\times10^7\Omega$ in resistance, Possible secondary transfer current output range: 0 to 100 μA (0 to 8 kV)

Both primary and secondary transfer biases are controlled by a constant current.

Embodiment 1

Below will be explained the first embodiment of the image forming apparatus. This image forming apparatus has a mode of controlling the primary transfer output. This control mode forms some sets of toner patches which are different in length at least along the main scanning direction on the image bearing member, transfers these toner patches to the intermediate transfer member while varying the primary transfer output, measures the density of each toner patch transferred to the intermediate transfer member, calculates the optimum primary transfer output value (primary transfer bias) from the result of measurement, and controls the primary transfer output by the resulting output value.

Figure 2:
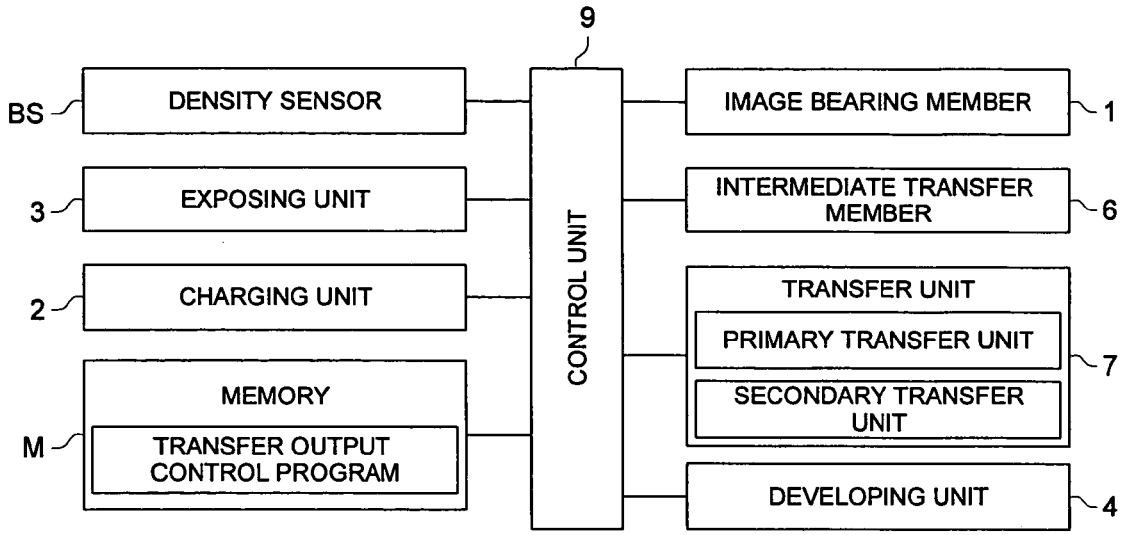
FIG. 2 is a control-related block diagram in accordance with Embodiment 1.

Next will be explained controlling of the image forming apparatus. FIG. 2 is a control-related block diagram in accordance with Embodiment 1. As shown in FIG. 2, control unit 9 controls respective functional blocks to execute a transfer output control program or the like. Density sensor BS is for the intermediate transfer member and memory M stores the transfer output control program.

Figure 3:
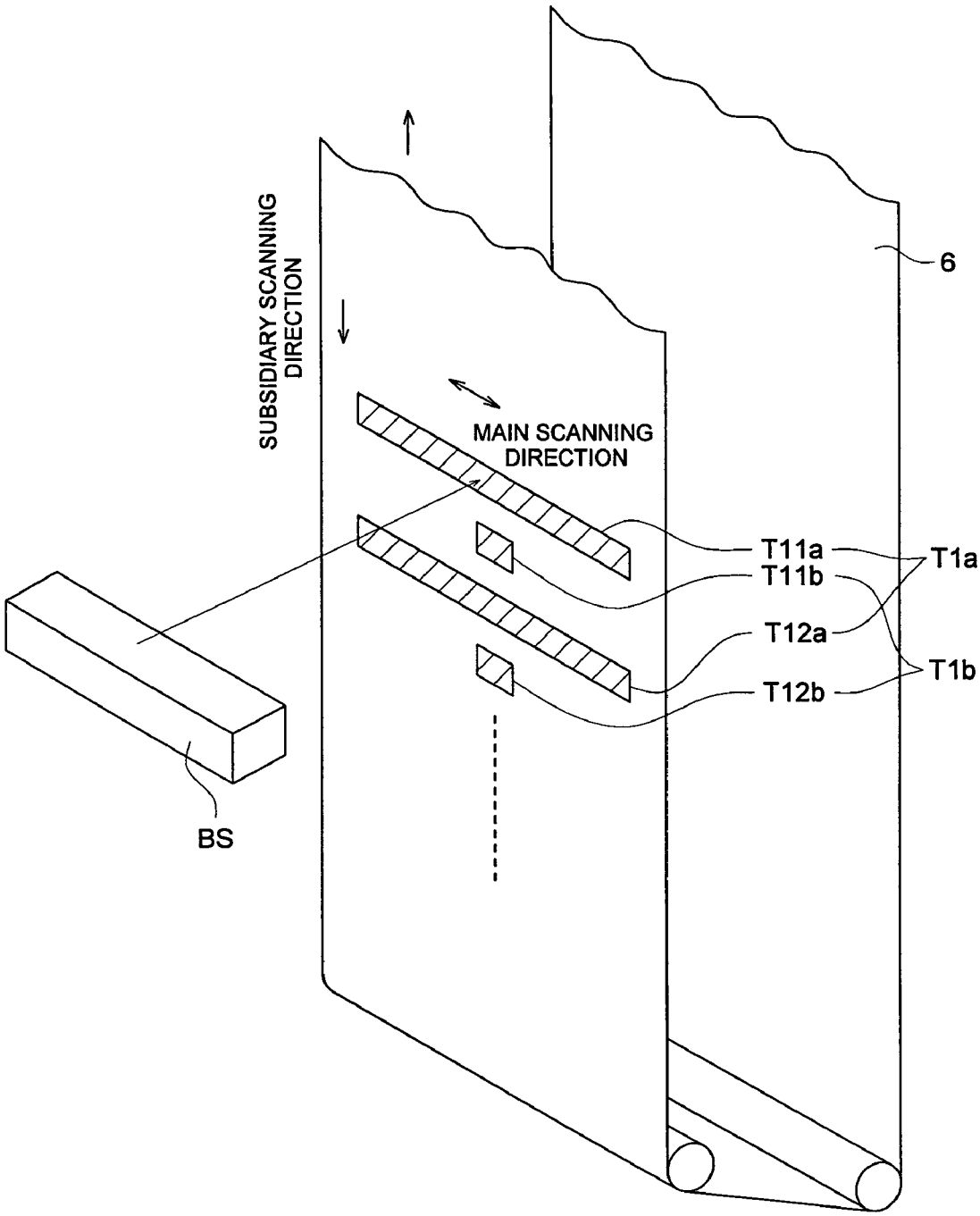
FIG. 3 is a perspective drawing which shows the layout of toner patches in accordance with Embodiment 1.

Next will be explained the layout of toner patches. FIG. 3 is a perspective drawing which shows the layout of toner patches in accordance with Embodiment 1. As shown in FIG. 3, the toner patches comprises first toner patch T1*a* and second toner patch T1*b*. The first toner patch T1*a* is copied into a plurality of first toner patches T11*a*, T12*a*, and so on while the primary transfer output is varied. Similarly, the second toner patch T1*b* is copied into a plurality of second toner patches T11*b*, T12*b*, and so on while the primary transfer output is varied. The first toner patch is 318 mm long (in the main scanning direction) by 30 mm wide (in the subsidiary scanning direction) and the second toner patch is 25 mm long (in the main scanning direction) by 30 mm wide (in the subsidiary scanning direction). The first and second toner patches T1*a* and T1*b* are alternately disposed along the subsidiary scanning direction. The first toner patch T1*a* is longer than the second toner patch T1*b* in the main scanning direction. The first toner patch T1*a* can be extended up to the maximum image formable length and the second toner patch T1*b* can be shrunk to a length which the density sensor BS can detect. Although two kinds of toner patches are used in the above description, it is apparent that three or more toner patches can be used which are different in length in the main scanning direction.

Figure 4:
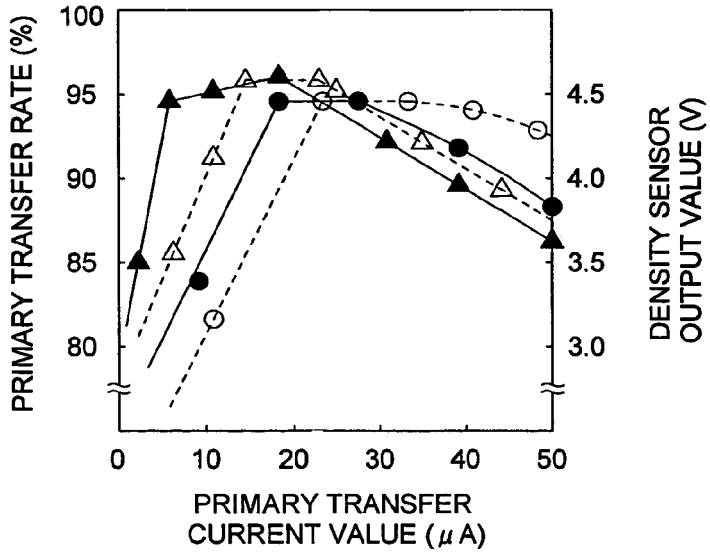
FIG. 4 shows a relationship between the primary transfer rate (%) and the density sensor output when the primary transfer output value is varied in Embodiment 1.
Figure 5:
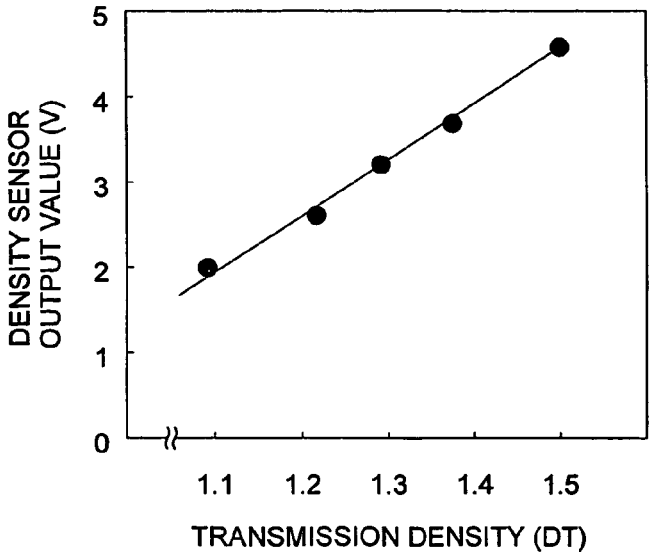
FIG. 5 shows a relationship between the transmission density and the output value of the density sensor.

Next will be explained how a primary transfer output value is calculated. FIG. 4 shows a relationship between the primary transfer rate (%) and the density sensor output when the primary transfer output value (the value of the primary transfer current) is varied in Embodiment 1. FIG. 5 shows a relationship between the transmission density and the output value of the density sensor BS. Here, the density sensor BS measures the densities of toner patches transferred to the intermediate transfer member.

Referring to FIG. 4, let's assume that the density of the first toner patch is TD1 and the density of the second toner patch is TD2 and that the primary transfer output value when TD1≦TD2 is the primary transfer output value when an image is formed. For example, the current value of the primary transfer output is 20 μA when the toner charge quantity is 30 Q/M and 30 μA when the toner charge quantity is 40 Q/M.

Below will be explained why Embodiment 1 can prevent a transfer failure which may be caused by immigration of greater toner particles or other particles. Immigration of a greater particle may cause a transfer failure mainly because it increases the distance between the image bearing member and the intermediate transfer member near the great particle and prevents toners from transferring from the image bearing member to the intermediate transfer member in the regular primary transfer output.

Meanwhile, when the second toner patch (which is shorter in the main scanning direction) is transferred to the intermediate transfer member, the primary transfer output will wrap around the toner patch. Therefore, the primary transfer output of the second toner patch must be increased than the primary transfer output of the first toner patch (which is longer in the main scanning direction) to obtain a sufficient primary transfer rate. In other words, the transfer failure due to immigration of greater particles is almost similar to the transfer failure which takes place when the second toner patches are transferred.

Therefore, the transfer failure due to immigration of greater particles can be prevented by using the primary transfer output at which the density TD2 of the second toner patch becomes greater than the density TD1 of the first toner patch as in Embodiment 1.

Figure 6:
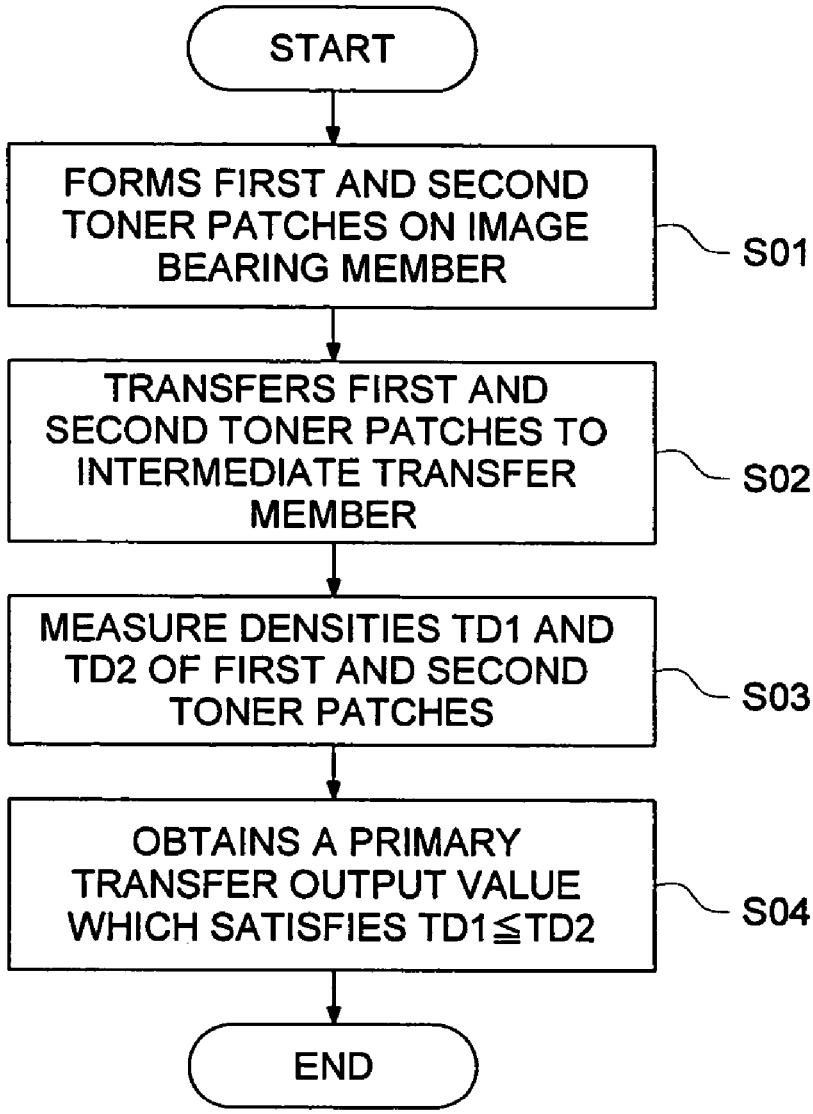
FIG. 6 shows an operation flow chart of transfer output controlling in accordance with Embodiment 1.

Below will be explained the transfer output controlling of the image forming apparatus with reference to FIG. 1, FIG. 2, FIG. 3, and FIG. 6. FIG. 6 shows an operation flow chart of transfer output controlling in accordance with Embodiment 1.

Step S01: Forms first toner patch T1*a* and second toner patch T1*b* on image bearing member 1.

Step S02: Transfers first toner patch T1*a* and second toner patch T1*b* to intermediate transfer member 6 (FIG. 3) while varying the primary transfer output value.

Step S03: Measures the densities of first toner patches T1*a* and second toner patches T1*b* on intermediate transfer member 6 by density sensor BS. (See FIG. 3.)

Step S04: Determines the primary transfer output value according to the result of measurement by density sensor BS when TD1≦TD2 (where TD1 is the density of the first toner patches and TD2 is the density of the second toner patches) and uses it as the primary transfer output value for actual image formation.

Although this case uses the value at a time of TD1≦TD2 as the primary transfer output value, it is apparent that an optimum primary transfer output can be determined from the other TD1-TD2 relationship.

As explained above, Embodiment 1 can obtain optimum primary transfer output values by a very simple control process and prevent a transfer failure due to immigration of greater toner particles and the other.

Embodiment 2

Next will be explained the image forming apparatus of Embodiment 2. This image forming apparatus has a secondary transfer output control mode. This control mode transfers a plurality of toner patches which are different in length in the main scanning direction from the image bearing member onto the intermediate transfer member and then transfers the toner patches from the intermediate transfer member onto transfer paper while varying the secondary transfer output of the secondary transfer unit. In this case, the optimum secondary transfer output value (secondary transfer bias) is obtained from the densities of toner patches left on the intermediate transfer member.

Figure 7:
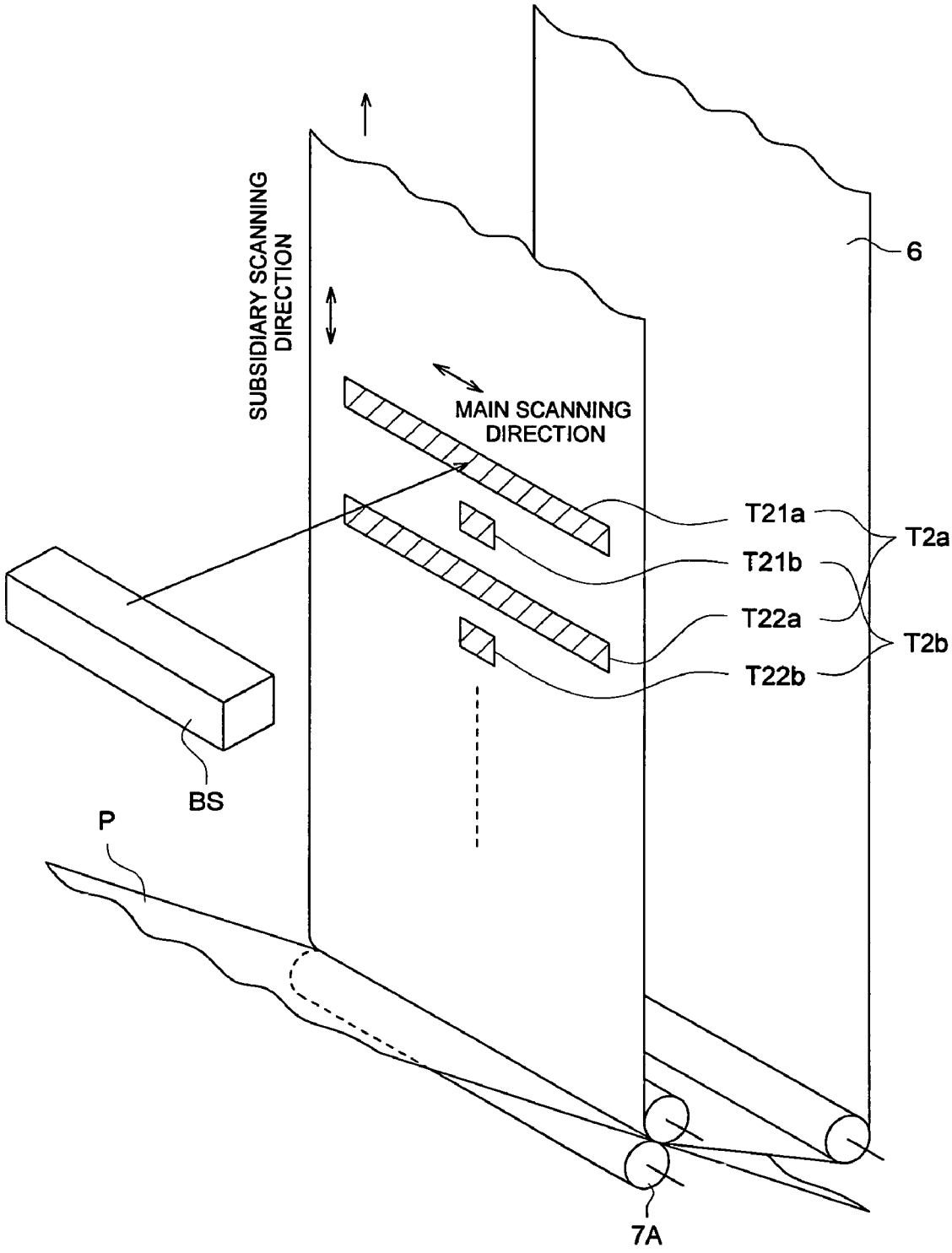
FIG. 7 is a perspective drawing showing the layout of toner patches in accordance with Embodiment 2.

Below will be explained the layout of toner patches used by Embodiment 2. FIG. 7 is a perspective drawing showing the layout of toner patches in accordance with Embodiment 2. As shown in FIG. 7, first toner patches T2*a* and second toner patches T2*b* are formed on the intermediate transfer member. Practically, toner patches are transferred from the image bearing member to the intermediate transfer member at a constant primary transfer output. The first toner patch T2*a* is copied (by transferring) into T21*a*, T22*a*, and so on. Similarly, second toner patch T2*b* is also copied (by transferring) into T21*b*, T22*b*, and so on. The first toner patch is 318 mm long (in the main scanning direction) by 30 mm wide (in the subsidiary scanning direction) and the second toner patch is 25 mm long (in the main scanning direction) by 30 mm wide (in the subsidiary scanning direction). The first toner patch T2*a* is longer than the second toner patch T2*b* in the main scanning direction. The first toner patch T2*a* can be extended up to the maximum image formable length and the second toner patch T2*b* can be shrunk to a length which the density sensor BS can detect. First and second toner patches T2*a* and T2*b* are transferred to the transfer paper P. Although two kinds of toner patches are used in the above description, it is apparent that three or more toner patches can be used which are different in length in the main scanning direction. Although two kinds of toner patches are used in the above description, it is apparent that three or more toner patches can be used which are different in length in the main scanning direction. As seen from the above explanation, the toner patches in Embodiment 1 are equal in shape to those in Embodiment 2. Embodiment 1 controls the primary transfer output, but Embodiment 2 controls the secondary transfer output.

Figure 8:
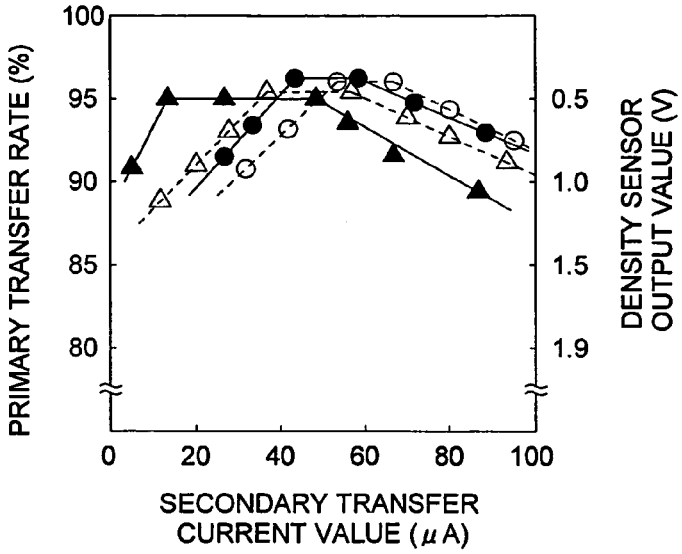
FIG. 8 shows a relationship between the secondary transfer rate (%) and the density sensor output when the secondary transfer output value is varied in Embodiment 2.
Figure 9:
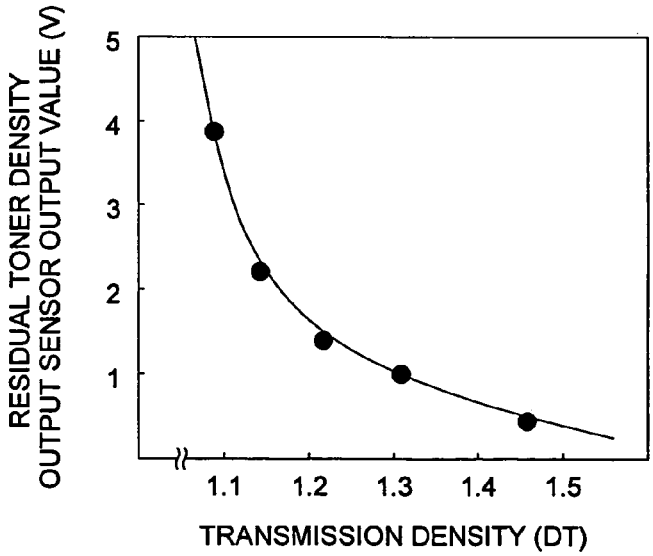
FIG. 9 shows a relationship between the transmission density and the output value of the density sensor.

Next will be explained how a secondary transfer output value is calculated. FIG. 8 shows a relationship between the secondary transfer rate (%) and the density sensor output when the secondary transfer output value is varied in Embodiment 2. In Embodiment 2, density sensor BS measures the densities of toner patches left on the intermediate transfer member after secondary transferring is complete. The actual secondary transfer output is determined from the secondary transfer output value measured when TD3≦TD4 (where TD3 is the density of the first toner patches and TD4 is the density of the second toner patches). Therefore, when the current value of the secondary transfer output is 20 μA when the toner charge quantity is 30 Q/M and 30 μA when the toner charge quantity is 40 Q/M. FIG. 9 shows a relationship between the transmission density and the output value of the density sensor.

Figure 10:
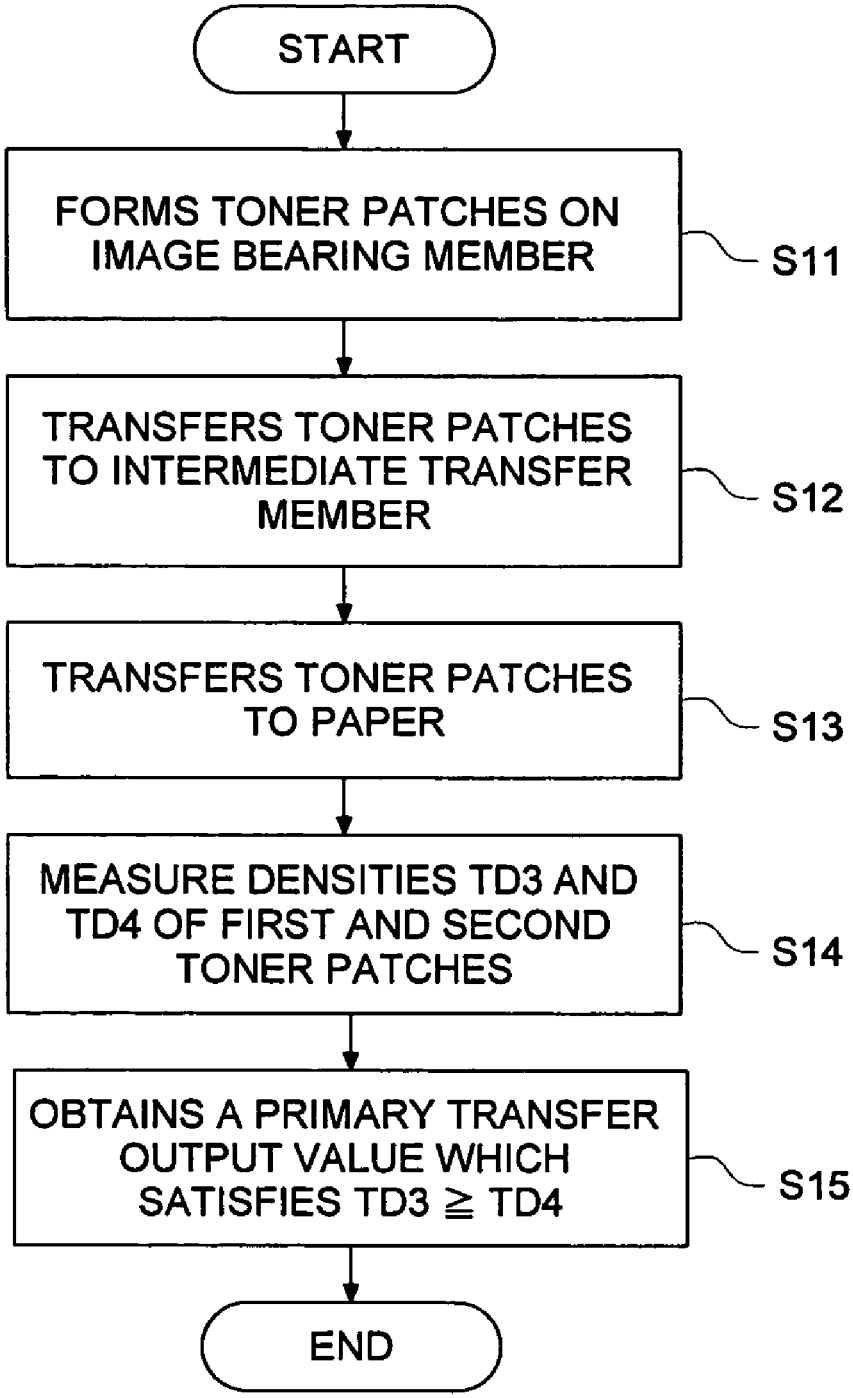
FIG. 10 shows an operation flow chart of transfer output controlling in accordance with Embodiment 2.

Below will be explained the transfer output controlling of the image forming apparatus with reference to FIG. 5, FIG. 7, and FIG. 10. FIG. 10 shows an operation flow chart of transfer output controlling in accordance with Embodiment 2.

Step S11: Forms first toner patch T2*a* and second toner patch T2*b* on image bearing member 1 (FIG. 1).

Step S12: Transfers first toner patch T2*a* and second toner patch T2*b* to intermediate transfer member 6 using a constant primary transfer output value.

Step S13: Transfers first toner patch T2*a* and second toner patch T2*b* from intermediate transfer member 6 to paper P while varying the secondary transfer output value.

Step S14: Measures the densities of first and second toner patches left on intermediate transfer member 6 by density sensor BS.

Step S15: Determines the secondary transfer output value according to the result of measurement by density sensor BS when TD3≧TD4 (where TD3 is the density of the first toner patches and TD4 is the density of the second toner patches) and uses it as the secondary transfer output value for actual image formation.

Although this case uses the value at a time of TD3≧TD4 as the secondary transfer output value, it is apparent that an optimum secondary transfer output can be determined from the other TD3-TD4 relationship. It is possible to optimize both first and second transfer outputs by using this embodiment together with Embodiment 1.

As explained above, Embodiment 1 can obtain optimum primary transfer output values by a very simple control process and prevent a transfer failure due to immigration of greater toner particles and the other. The reason why Embodiment 2 can prevent the transfer failure is basically the same as that why Embodiment 1 can prevent the transfer failure.

Embodiment 3

Next will be explained the image forming apparatus of Embodiment 3. This image forming apparatus has a primary transfer output control mode. This primary transfer output control mode forms, on the image bearing member, a triangular toner patch whose longitudinal length (along the main scanning direction) is reduced continuously in the subsidiary scanning direction, transfers toner patches of two or more colors onto the intermediate transfer member while varying the primary transfer output value, measures the densities of the toner patches long the subsidiary scanning direction on the intermediate transfer member, calculates the primary transfer output value (primary transfer bias) from the result of measurement, and uses it for actual controlling.

Figure 11:
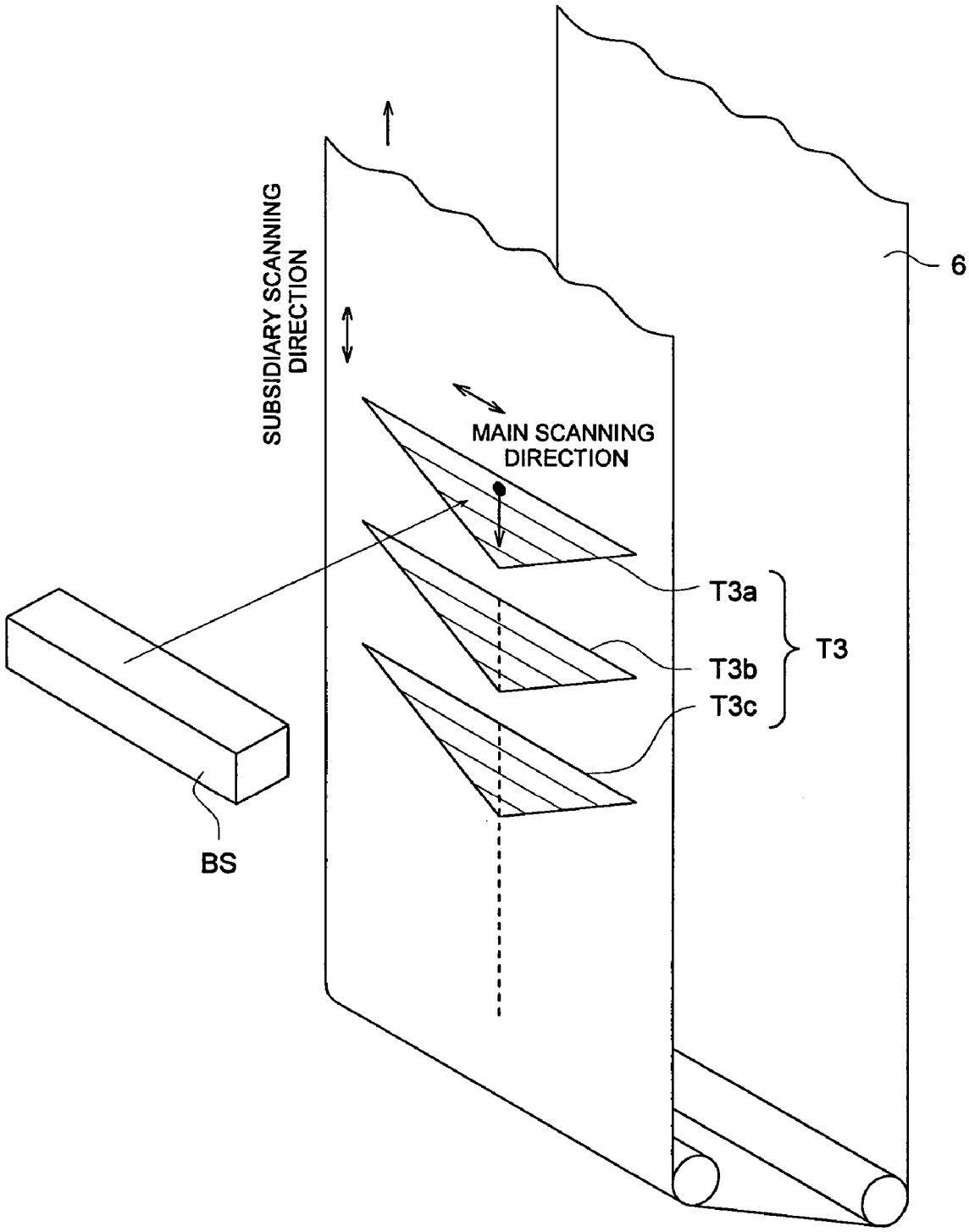
FIG. 11 is a perspective drawing showing the layout of toner patches in accordance with Embodiment 3.

Below will be explained the layout of toner patches used by Embodiment 3. FIG. 11 is a perspective drawing showing the layout of toner patches in accordance with Embodiment 3. As shown in FIG. 11, toner patch T3 formed on intermediate transfer member 6 is a triangular toner patch whose longitudinal length (along the main scanning direction) is reduced continuously in the subsidiary scanning direction (a triangular toner patch which is narrower along the subsidiary scanning direction) and contains two or more colors. The toner patch T3 is copied into toner patches T3*a*, T3*b*, T3*c*, and so on (in a line along the subsidiary scanning direction) when transferred from the image bearing member to the intermediate transfer member while varying the primary transfer output value. An identical primary transfer output is applied to the overprinted toner patches of different colors.

Figure 12:
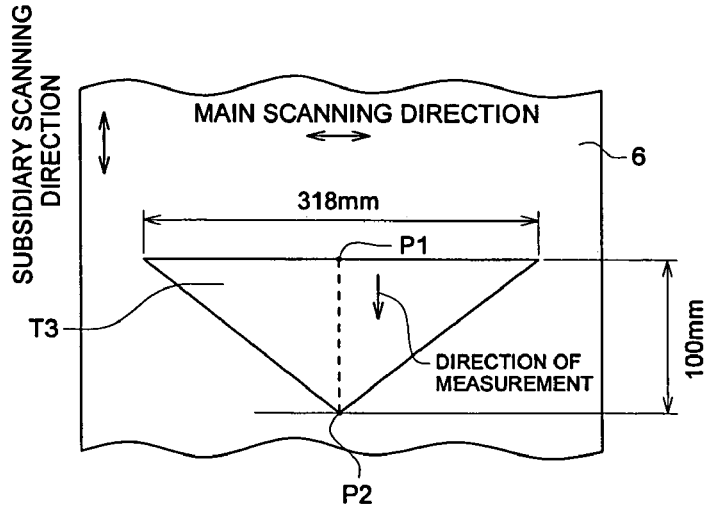
FIG. 12 is an explanatory drawing of the transfer output controlling in accordance with Embodiment 3.
Figure 12:
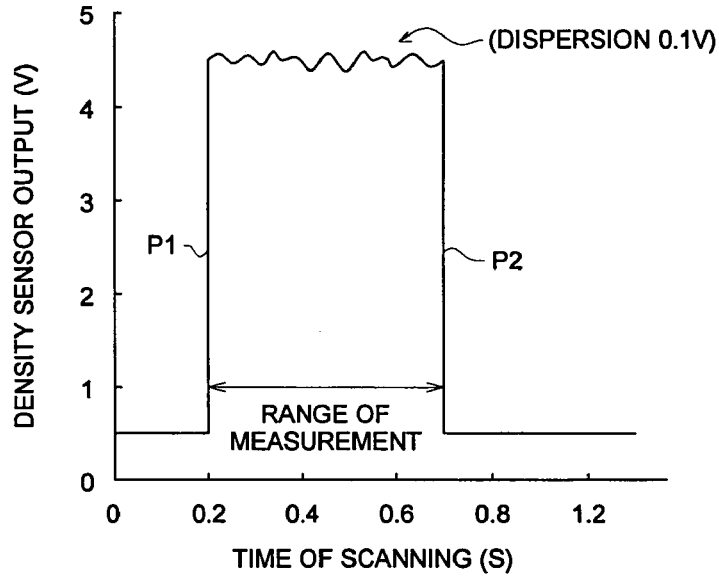
Figure 12:
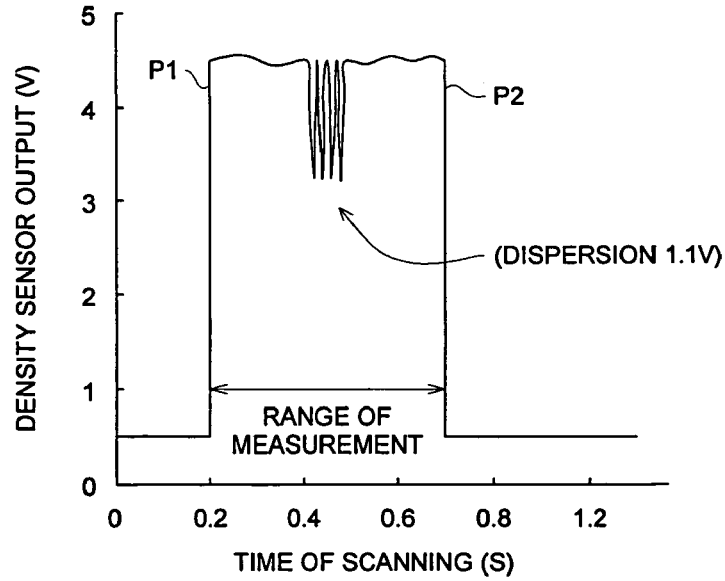

Next will be explained how an optimum primary transfer output value is calculated. FIG. 12 is an explanatory drawing of the transfer output controlling in accordance with Embodiment 3. FIG. 12(*a*) shows the shape of the toner patch and the direction of measurement. FIG. 12(*b*) and FIG. 12(*c*) show out waveforms of the density sensor obtained by measuring the density of the toner patch continuously while moving the toner patch. FIG. 12(*b*) shows a density sensor output waveform without any output value dispersion. This means that the intermediate transfer member has no toner to be transferred again to the image bearing member and that no discharging takes place. In this example, the dispersion of the density sensor output is 0.1V. Contrarily, FIG. 12(*c*) shows a density sensor output waveform having a great output value dispersion. This waveform appears when the intermediate transfer member has toner to be transferred again to the image bearing member and when discharging generates. In this example, the measured dispersion in the density sensor output is 1.1 V.

Figure 13:
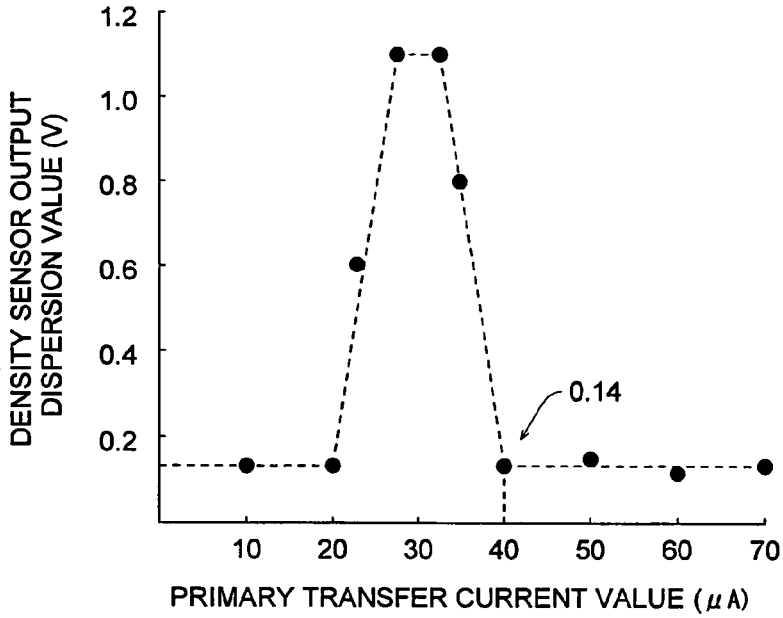
FIG. 13 shows a dispersion of the density sensor output when the primary transfer output value is varied.

FIG. 13 shows a dispersion of the density sensor output plotted while the primary transfer output value is varied. In other words, this drawing plots the dispersions in outputs of density sensor which measures the toner patches transferred to the intermediate transfer member at different primary transfer output values.

Embodiment 3 primarily transfers toner patches from the image bearing member to the intermediate transfer member while varying the primary transfer output value, measures the dispersion of the output the density sensor in measurement of each transferred toner patch, finds a dispersion below a preset dispersion value, and uses it as the primary transfer output value for actual image formation. In the example of FIG. 13, the optimum primary transfer output value is 40 μA. At more than 40 μA, the toners are likely to be transferred from the intermediate transfer member back to the image bearing member in the succeeding transfer processes (discharge phenomenon).

Figure 14:
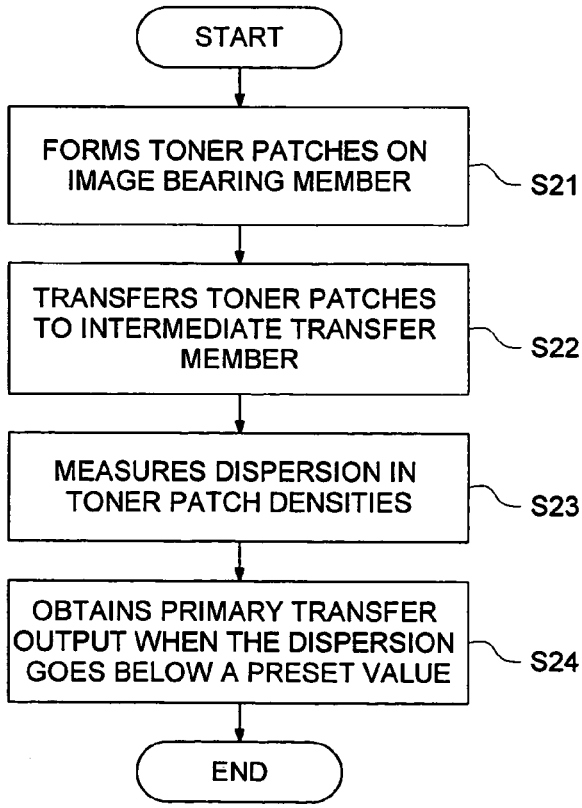
FIG. 14 shows an operation flow chart of transfer output controlling in accordance with Embodiment 3.

Below will be explained the transfer output controlling of the image forming apparatus with reference to FIG. 11 and FIG. 14. FIG. 14 shows an operation flow chart of transfer output controlling in accordance with Embodiment 3.

Step S21: Forms yellow (Y) and cyan (C) toner patch T3 respectively on the associated image bearing members 1Y and 1C.

Step S22: Transfers respective toner patches T3 to intermediate transfer member 6 while varying the primary transfer output value for each color. However, an identical primary transfer output is applied to yellow and cyan toner patches that are transferred to the same position on intermediate transfer member 6.

Step S23: Measures the densities of toner patches T3 of two colors on the intermediate transfer member by density sensor BS.

Step S24: Obtains the primary transfer output value when the dispersion in the density sensor output is below a preset value. It is possible to obtain an optimum primary transfer output for combinations of the other colors in the similar manner.

As explained above, Embodiment 3 can perform optimum primary transferring by a very simple control process without re-transferring toners back to the image bearing member (discharge phenomenon), form high-quality images, and prevent a transfer failure due to immigration of greater toner particles and the other.

Below will be explained the results of endurance tests on the embodiments of the image forming apparatus. Each image forming apparatus actually made 200,000 copies for test.

EVALUATION EXAMPLE 1

(Test System)

The image forming apparatus of FIG. 1 was used together with first and second toner patches of Embodiment 1. The transfer unit was controlled with a constant current. The value when the toner patch densities satisfy TD1≦TD2 was used as the primary transfer output.

(Evaluation Items and Method)

The transferability is evaluated by symbols "A" for good transferring and "B" for transfer failure.

(Test Result)

Table 1 shows the test result.

TABLE 1

| Transferability | At the start time (20° C., 50%) | After 100,000 copies (10° C., 20%) | After 200,000 copies (30° C., 80%) |
|---|---|---|---|
| Toner charge (μc/g) | 40 | 50 | 45 |
| This evaluation example | A | A | A |
| Comparative example: Prospective control ATVC control | A | A | B |

As seen in Table 1, the charged toner quantities are measured "At the start time," "After 100,000 copies," and "After 200,000 copies." This evaluation example can perform transferring at a good accuracy and obtain high-quality images. The comparative examples (prospective control and ATVC control) can make good transferability when the estimated toner charge quantity is in the range of 25 (μc/g) to 30 (μc/g) (including both). However, after 200,000 copies, the operating temperature and relative humidity are respectively 30° C. and 80%. The toner charge quantity is higher than expected. (This is not good.)

EVALUATION EXAMPLE 2

(Test System)

The image forming apparatus of FIG. 1 was used together with first and second toner patches of Embodiment 2. The transfer unit was controlled with a constant current. The value when the toner patch densities satisfy TD3≧TD4 is used as the secondary transfer output.

(Evaluation Items and Method)

The transferability is evaluated by symbols "A" for good transferring and "B" for transfer failure.

(Test Result)

Table 2 shows the test result.

TABLE 2

| Transferability | At the start time (20° C., 50%) | After 100,000 copies (10° C., 20%) | After 200,000 copies (30° C., 80%) |
|---|---|---|---|
| Toner charge (μc/g) | 40 | 50 | 45 |
| This evaluation example | A | A | A |
| Comparative example: Prospective control ATVC control | A | A | B |

As seen in Table 2, the charged toner quantities are measured "At the start time, "After 100,000 copies," and "After 200,000 copies." This evaluation example can perform transferring at a good accuracy and obtain high-quality images. The comparative examples (prospective control and ATVC control) can make almost good transferability when the estimated toner charge quantity is in the range of 25 (μc/g) to 30 (μc/g) (including both). However, after 200,000 copies, the operating temperature and relative humidity are respectively 30° C. and 80%. The toner charge quantity is higher than expected. (This is not good.)

EVALUATION EXAMPLE 3

(Test System)

The image forming apparatus of FIG. 1 was used together with triangular toner patches of FIG. 11. The output control is made with a constant current. The primary transfer output is the sum of 3 μA and the smallest output value when the dispersion goes below 0.15V while the transfer current is increased.

(Evaluation Items and Method)

The transferability is evaluated by symbols "A" for good transferring and "B" for transfer failure. (Test result)

Table 3 shows the test result.

TABLE 3

| Transferability | At the start time (20° C., 50%) | After 100,000 copies (10° C., 20%) | After 200,000 copies (30° C., 80%) |
|---|---|---|---|
| This evaluation example | A | A | A |
| Comparative example: Prospective control and ATVC control | A | B(Electric discharge) | A |

As shown in Table 3, this evaluation example can perform transferring at a good accuracy and obtain high-quality images. However, after 100,000 copies in the comparative examples (prospective control and ATVC control), the operating temperature and relative humidity are respectively 10° C. and 20%. The toner charge quantity is not what is expected. (This is not good.)

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus, comprising:

an image bearing member;

an intermediate transfer member;

a transfer unit which transfers toner images formed on the image bearing member to the intermediate transfer member at a primary transfer bias, and then transfers the toner images on the intermediate transfer member to a substrate at a secondary transfer bias;

a control unit which forms a plurality of toner patches on the image bearing member, which are categorized into at least two groups according to their width in the main scanning direction, and transfers the toner patches to the intermediate transfer member at various primary transfer biases; and a density sensor which measures densities of the toner patches transferred to the intermediate transfer member;

wherein the toner patches are categorized into a first group in which toner patches have a long length in the ,main scanning direction and a second group in which toner patches have a short length in the main scanning direction, and wherein the control unit sets the optimum primary transfer bias based on the measuring results of the toner patches in the first group and in the second group.

2. An image forming apparatus as claimed in claim 1, wherein the control unit sets the optimum primary transfer bias at which densities of the toner patches in the first group are lower than that in the second group.

3. An image forming apparatus as claimed in claim 1, wherein the length of the toner patches in the first group can be extended up to the maximum image formable length.

4. An image forming apparatus as claimed in claim 3, wherein the length of the toner patches in the second group can be shrunk to a length which the density sensor can be detected.

5. An image forming apparatus as claimed in claim 1, wherein the first and second toner patches are alternatively disposed along the subsidiary scanning direction.

6. An image forming apparatus as claimed in claim 1, wherein the transfer unit is operated with constant current control.

7. An image forming apparatus as claimed in claim 1, wherein the image forming apparatus is a color copier or a color printer.

* * * * *